US006190605B1

(12) United States Patent
Cadle et al.

(10) Patent No.: US 6,190,605 B1
(45) Date of Patent: Feb. 20, 2001

(54) DRY DIE WALL LUBRICATION

(75) Inventors: Terry M. Cadle, Wauwatosa; Joel H. Mandel, Hartford; Paul R. Roskopf, Richfield, all of WI (US)

(73) Assignee: Zenith Sintered Products, Inc., Germantown, WI (US)

( * ) Notice: Under 35 U.S.C. 154(b), the term of this patent shall be extended for 0 days.

(21) Appl. No.: 09/402,525

(22) PCT Filed: Apr. 8, 1998

(86) PCT No.: PCT/US98/07090

§ 371 Date: Dec. 21, 1999

§ 102(e) Date: Dec. 21, 1999

(87) PCT Pub. No.: WO98/45072

PCT Pub. Date: Oct. 15, 1998

Related U.S. Application Data

(60) Provisional application No. 60/043,221, filed on Apr. 9, 1997.

(51) Int. Cl.[7] ..... B22F 3/00
(52) U.S. Cl. ..... 419/66; 419/36
(58) Field of Search ..... 419/66, 36

(56) References Cited

U.S. PATENT DOCUMENTS 3,871,877 * 3/1975 Storchheim .
4,228,670 * 10/1980 Corti et al. .
5,017,122 * 5/1991 Staniforth .
5,085,828 * 2/1992 Shain et al. ..... 419/66
5,093,076 * 3/1992 Young et al. ..... 419/12
5,682,591 * 10/1997 Inculet et al. ..... 419/38

FOREIGN PATENT DOCUMENTS

0698435 A1 2/1996 (EP) .

OTHER PUBLICATIONS

PCT Search Report dated Jul. 24, 1998 in International Appln. No. PCT/US98/07090.

Patent Abstracts of Japan, Publ. No. 01172502, publ. date Jul. 7, 1989, "Sintering Cold Forging Method," inventor Y. Kazuyuki, applicant Mazda Motor Corp.

Patent Abstracts of Japan, Publ. No. 04173903, publ. date Jun. 22, 1992, "Method for Forging Powder of Aluminum Alloy," inventor Akechi Kiyoaki, applicant Sumitomo Electric Ind. Ltd.

* cited by examiner

*Primary Examiner*—Ngoclan Mai
(74) *Attorney, Agent, or Firm*—Quarles & Brady LLP

(57) ABSTRACT

A method for high density long fill compaction of metallic powders uses a precisely temperature controlled mold and a dry sprayed lubricant which has the characteristic of softening on contact with the mold and smearing on the mold wall during compaction, yet on ejection not causing powder adherence.

6 Claims, No Drawings

DRY DIE WALL LUBRICATION

This application is a national stage of PCT/US98/07090 filed Apr. 8, 1998 which claims the benefit of U.S. Provisional Application No. 60/043,221 filed Apr. 9, 1997.

FIELD OF THE INVENTION

This invention relates to lubrication of molds used for the compaction of metal powders, as is done in preparing metal powder compacts for sintering.

BACKGROUND OF THE INVENTION

Powder metallurgy is a well established process for the manufacture of a wide range of products for various applications. In its simplest form, the process involves pouring fine powders into a precision metal mold which has moveable elements (FIG. 1) and then applying pressure to the powder to form a "compact". The compact is then ejected from the mold by a relative upwards motion of the bottom tool element (punch). Holes can be formed in the compact by use of "core-pins". The compact is then subjected to a thermal process called "sintering" which involves heating the compact in a temperature controlled furnace under a protective atmosphere to effect powder particle bonding and alloying which results in a strong metal product that can be used for structural and mechanical purposes.

It is also well known that the physical and mechanical properties of the "sintered product" are highly dependent upon its density. Since both static and dynamic strength are highly valued properties of materials, there has been extensive work in both academic and industrial arenas to increase the density at low cost. There are several costly ways of achieving this high density goal: double processing which involves restriking the sintered product and then resintering it, hot forging the sintered product, and recently "warm pressing" of powder mixes involving special expensive lubricants and binder powder additives plus a system for precision heating of the powder mixture prior to compaction in warm tooling.

The present invention, however, is an improvement on another approach which involves lubrication of the vertical surfaces of the mold elements (tools). This invention allows elimination of powder lubricants normally added to the mix to facilitate ejection of the compact from the mold to occur without scoring or galling of the tools from cold welding of metal powder particles to metal tool elements. Elimination of the pressing lubricants which are light soap-like powders such as an organic stearate, clears the way for extra metal powder densification at high compacting pressures.

Mold wall lubrication is not new. In fact, it has been practiced commercially at Zenith Sintered Products, Germantown, Wis. U.S.A. since before 1985 under the trade name Z95 Plus. This, however, involved a liquid lubricant spray onto the tool surfaces. A drawback to the process is that the resulting compact surface is wet, and this collects and holds loose powder which bonds to the compact in the sintering stage. The result can be unacceptable quality products. The washing of compacts has been used to overcome this problem, but the washing process has its own problems. The liquid carrier medium also presents problems since it must be volatile yet meet stringent safety regulations.

The search for a dry powder sprayed on mold coating was therefore a direction of research. Recently a process involving charging the lubricant powder particles electrostatically and spraying them onto the mold which is electrically grounded has been developed and the results published widely. A major limitation with this process is with respect to the depth of mold that can be effectively coated to permit ejection of a compact under high pressing pressures. A variety of lubricant powders were sprayed onto mold wall surfaces using a "Tribostatic Sprayer" which was attached to a production compacting press using production tooling to make a right cylinder of approximate dimensions 1.5 inches outer diameter, 1.0 inches inner diameter. It was found by experimentation that at high pressing pressures (above 50 tons per square inch) the maximum density achievable of an iron-carbon-copper powder mix was limited to 7.25 grams per cubic centimeter and the vertical length (height) was limited to about 0.5 inches. The limiting mechanism governing the height of the compact was the removal of powder lubricant from the top half of the mold surface during the powder compaction stage. Since the powder height is about halved during compaction, the top half of the mold wall, past which the compact must be ejected, is dry and unlubricated prior to ejection. This leads to scoring and galling of the mold surface on ejection. It was confirmed that wet spraying of the mold surface did not suffer from this effect, since a wet residue is left on the upper half of the mold wall during compaction, that provides lubrication during compact ejection.

SUMMARY OF THE INVENTION

An object of the invention, therefore, is to take advantage of the dry powder spray system yet provide a residual "wet" type wall lubrication, and yet avoid a wet compact when it is ejected to avoid powder adherence.

In practicing the invention the mold is precisely heated prior to and during compaction to a narrow temperature band, and a dry powder lubricant is selected that has an ideal softening and melting characteristic to match that temperature range. As a result, on contact with the warm mold wall the lubricant powder particle softens and sticks to the surface. When the metallic powder is compacted, it "wipes" the soft lubricant powder down the mold wall surface, thereby smearing a residual film for effective subsequent ejection. Careful selection and control of lubricant type, condition, and mold temperature range is essential for optimum performance.

Using this process has resulted in the ability to compact rings on the annular tooling described earlier to above 7.35 grams per cubic centimeter density, with a height of at least 1.0 inches which is at the limitation of the tooling. On ejection, the compacts were non-adherent to loose powder.

Other objects and advantages of the invention will be apparent from the detailed description.

DETAILED DESCRIPTION OF THE PREFERRED EMBODIMENT

This invention provides a method of achieving an increased length and density product by powder metallurgy by dry powder lubricant spraying onto temperature controlled mold walls where the lubricant softening and melting temperatures produce a smeared but not wet coating on the mold walls. This allows taller compacts to be produced than is possible with current dry powder mold wall processing.

EXAMPLE OF PROCESS

A powder blend of pre-alloyed iron-nickel molybdenum powder (0.7% nickel, 0.5% molybdenum) plus 0.7% graphite was poured into a mold made from tungsten carbide with high speed steel punches. The annular mold dimensions were 1.5 inches outer diameter, 1.0 inches inner diameter with a powder fill depth of 2.0 inches. The mold walls were heated and temperature controlled using 4 rod type heating elements and a controller to a range of 175° F. to 200° F. which was measured by a built-in thermocouple, and checked by a hand held surface contact thermocouple. The powder lubricant used was synthetic polyethylene wax with a softening point of 145° F. and a melting point of 207° F. The powder was delivered by a commercially available "Tribostatic powder spray system" which is not part of this invention. It was found that cold mold compaction using the following lubricants: zinc stearate, lithium stearate, stearic acid, acrawax, and including the lubricant of this example, could only achieve 7.25 grams per cubic centimeter density to a maximum depth of only 0.5 inches of compaction. It was found that substitution of a wet spray enabled a full 1.0 inches of compaction to be achieved, but the result was a wet compact which collected loose powder on the surface and suffered from excess lubricant in some corners of the tooling.

When the mold was pre-heated to 175 ° F. and the wax powder lubricant was sprayed onto the mold surface, an immediate improvement was evident. The full 1.0 inch length capability of the tooling was useable and a density of 7.35 grams per cubic centimeter was readily achieved. The resulting compacts were hot to the touch but dry enough not to collect loose powders. This was found to be consistent and reproducible in a short production run, which indicated it will be a commercially viable process.

Therefore, the invention provides a process for high density long fill compaction of metallic powders using a precisely temperature controlled mold and a dry sprayed lubricant powder which has the characteristic of softening on contact with the mold and smearing on the mold wall during compaction, yet on ejection not causing powder adherence.

In a preferred form, the mold wall is heated by any suitable means to a temperature range which is between the softening and melting points of the lubricant, and the warmed wall is sprayed or otherwise coated with the lubricant. As the metal powder and punch wipe along the mold wall during compaction, the lubricant coating is smeared on the wall, leaving a lubricant residue on the wall to lubricate the ejection of the compact from the mold.

A preferred method of practicing the invention has been described in considerable detail. Many modifications and variations to the method described will be apparent to those skilled in the art. For example, a lubricant other than polyethylene wax could be used, and it could be coated on the die walls by any suitable means of application, whether by spraying or not.

We claim:

1. A method of compacting metal powder in a compaction mold to prepare a metal powder compact for sintering, comprising:

controlling the surface temperature of walls of said mold to be at a temperature which is between a softening temperature and a melting temperature of a lubricant;

applying said lubricant to said walls;

charging said mold with powder metal, with said powder metal contacting said lubricant applied to said walls;

compacting said powder metal in said mold while maintaining the surface temperature of said walls of said mold at said temperature which is between a softening temperature and a melting temperature of said lubricant; and ejecting said compacted powder metal from said mold.

2. A method as claimed in claim 1, wherein said lubricant is in solid phase at room temperature.

3. A method as claimed in claim 1, wherein said compacting step is carried out until said powder metal has reached fifty percent or less of its original uncompacted height.

4. A method as claimed in claim 1, wherein said lubricant softens upon contact with said walls of said mold.

5. A method as claimed in claim 1, wherein said lubricant is smeared on said walls of said mold during said compaction step.

6. A method as claimed in claim 1, wherein powder metal particles do not adhere to said compacted powder metal part after ejection.

* * * * *